US005864518A

United States Patent [19]

Geiser

[11] Patent Number: 5,864,518

[45] Date of Patent: Jan. 26, 1999

[54] DEVICE AND METHOD FOR ANALYZING A SWIMMER'S SWIM STROKE

[75] Inventor: William P. Geiser, Dallas, Tex.

[73] Assignee: Performance General Corporation, Dallas, Tex.

[21] Appl. No.: 626,205

[22] Filed: Mar. 29, 1996

[51] Int. Cl.[6] ..... G04B 47/00

[52] U.S. Cl. ..... 368/10; 368/89

[58] Field of Search ..... 368/69, 20, 185, 368/321, 320, 224, 89

[56] References Cited

U.S. PATENT DOCUMENTS

| | | | |
|---|---|---|---|
| 3,823,550 | 7/1974 | Bergey | 368/69 |
| 4,257,117 | 3/1981 | Besson | 368/69 |
| 4,435,090 | 3/1984 | Jaccard | 368/32 |
| 4,468,131 | 8/1984 | Bui et al. | 368/69 |

*Primary Examiner*—Bernard Roskoski
*Attorney, Agent, or Firm*—Waren & Perez

[57] ABSTRACT

A device and method for measuring, calculating and displaying swim related information includes a waterproof enclosure with an internal microcomputer programmed to calculate various indicators of swim performance including number of strokes, stroke cycle, stroke rate, velocity and swim stroke efficiency among others. The device is self contained and strapped to the swimmer's wrist during swimming. Function buttons on the exterior of the device control its operation and allow the swimmer to select from various exercise modes and display features. A swim stroke is detected by the use of metallic sensors which extend along the top surface of the device. The sensors act as a short circuit when submerged in water to cause an interrupt condition of the internal microprocessor corresponding to a stroke. The device is secured to a swimmer's wrist by one or more adjustable straps.

21 Claims, 7 Drawing Sheets

DEVICE AND METHOD FOR ANALYZING A SWIMMER'S SWIM STROKE

TECHNICAL FIELD

The present invention relates in general to an apparatus for use during swim related activities and in particular to a computerized wrist mounted instrument and method for measuring, analyzing and displaying quantitative information about a swimmer's swim stroke.

BACKGROUND OF THE INVENTION

Without limiting the scope of the invention, its background is described in connection with a device that is mounted on a swimmer's wrist and worn by the swimmer while in the water.

Swimming has long been recognized as one of the most demanding and competitive sports in the world. Over the years, a variety of swimming aids have been developed and used by swimmers to train and improve swim performance. Such aids have been designed with the goal of increasing the swimmer's swim stroke efficiency and improving stroke technique and power.

Most swimming aids work on the underlying principle that increased resistance during the swim stroke will result in increased stroke power and therefore improve performance. In essence, performance improves as the swimmer's ability to push water backwards along a line pursued by the swimmer's body increases. Thus, the faster a swimmer can pull his hand through the swim stroke cycle, the greater his speed in the water.

Still other training techniques attempt to improve the swimmer's swim stroke efficiency by developing the swimmer's ability to move water with long, powerful swim strokes to propel the swimmer forward. On the one hand, efficiency depends on a variety of swim techniques such as hand positioning, arm motion, hand pull and body rotation among others. On the other hand, factors such as the number of strokes taken as a function of distance, average stroke cycle rate, velocity, and elapsed time also play a big part in defining the efficient swim stroke.

Whether a swimmer desires to increase swim stroke technique or swim stroke efficiency, there are currently no readily available low cost diagnostic and training tools to allow the swimmer to determine, monitor, and analyze his or her performance.

While prior art methods exist to test and analyze swim performance, such methods are normally reserved for the elite swimmers who are invited to train or practice at multi-million dollar training centers in preparation for national or international events. Such centers use sophisticated and expensive training equipment including swimming treadmills, video recorders, computers and enhanced timing systems. Thus, there are no known simple and cost effective diagnostic tools for use by the up and coming athlete in training or for the recreational and fitness swimmer.

Another prior art method, such as that used by the International Center for Aquatic Research, involves filming swimmers underwater to obtain the individual swimmer's distance per stroke and turnover rate (strokes per minute). The equipment, facilities and staff are provided for coaches and swimmers during competition to allow the swimmer to make adjustments in swim technique. As with other prior art methods, the up and coming athlete or recreational swimmer does not normally have the resources or access to such methods and equipment.

Prior devices have been developed and used by swimmers for training and conditioning purposes. For example, U.S. Pat. No. 4,832,643 to Schoofs describes a hand paddle made out of plastic materials or hard rubber which the swimmer can wear on his hands to develop a stronger swim stroke. Another prior art device is described in U.S. Pat. No. 5,147,233 to Hannula wherein a swimming training paddle is described having a textured leading surface which captures water and permits the swimmer to increase swim stroke power.

While these prior methods are designed to develop swim stroke force and increase power, such devices do not allow the swimmer to gauge his progress by determining a swimmer's stroke rate and stroke time as a function of a particular technique used or distance swam. Until the present invention, the average swimmer was unable to obtain accurate swim stroke time and stroke rate information. Furthermore, until the present invention, the average swimmer had no indication as to whether a particular swim technique was efficient in terms of increasing swim speed and getting the most out of each stroke. A device that allows a swimmer to identify the variables which manufacture swim speed is in great demand.

Thus, there currently is a need for an easy to use and inexpensive device for measuring, analyzing and viewing analytical and quantitative information regarding a swimmer's stroke. There is also a need for such a device that permits the swimmer to determine average swim stroke cycle rates and times as a function of the distance swam. Such a method and device would allow swimmers to gauge their swim stroke and make corresponding adjustments in technique.

Likewise, a need exists for a device that determines the number of strokes taken by a swimmer as a function of distance and elapsed time. Furthermore, there is a need for a device that is inexpensive and available to swimmers of all skill levels and ages. A device that can be mounted to the swimmer's wrist or other body part during the swim exercise, but does not interfere with proper swim stroke form or interrupt swim motion during the exercise would fill the niche left open by prior art training devices and methods.

SUMMARY OF THE INVENTION

Given the void left open by prior art devices and methods, it is a principle object of the present invention to provide a simple and efficient method and device for obtaining quantitative information about a swimmer's swim stroke including elapsed time, stroke rate, cycle time, distance swam, velocity and other indicators of a swimmer's performance to allow the swimmer to analyze swim stroke technique efficiency and performance.

It is another object of the present invention to provide a device that is capable of ascertaining and determining the average rate, number of strokes and distance per stroke during a given exercise, event or distance swam. This is accomplished by providing a wrist strapped instrument, similar in appearance to a typical watch, that computes and tracks a swimmer's swim stroke cycle, counts the number of strokes taken by the swimmer in a given distance, determines the total elapsed time, speed, stroke rate and other factors.

Yet another object of the present invention to provide a device that is easily mounted to the swimmer's wrist but does not obstruct, impede or affect proper swim stroke, form or efficiency. This is accomplished by a device that combines a plurality of electronic components, in a lightweight waterproof enclosure which is securely fastened to the swimmer's wrist by one or more straps.

Stroke count and elapsed time measurements are achieved by using two metallic sensors which short circuit while the device is in water and cause an interrupt signal to an internal microprocessor within the device to be generated. The internal microprocessor counts each stroke taken by the swimmer during the swim exercise and calculates a plurality of swim stroke indicators which are displayed on the device's Liquid Crystal Display ("LCD"). The internal microprocessor keeps track of the number of strokes taken from start to finish corresponding to the time from when the swimmer's hand first enters the water and the user depresses an "OFF" function button on the device.

From the stroke count and time measurements, the internal microprocessor computes a plurality of swim performance indicators including among others the swimmer's swim cycle rate, velocity, distance per stroke and Swim Efficiency Index (SEI). Elapsed time and number of strokes can be stored in an internal memory area and recalled later by the user for reference and comparison.

The LCD allows the user to scroll through stored swim data via one or more function and/or control buttons located on the exterior of the device. The LCD is controlled by an internal display driver which, in turn, receives swim data from the internal microprocessor.

One or more straps hold the device in place and firmly on the user's wrist to ensure the device enters and leaves the water during a complete stroke cycle.

BRIEF DESCRIPTION OF THE DRAWINGS

Various features of the present invention are pointed out with particularity and the claims annexed to and forming a part of this disclosure. For a better understanding of the invention, its operating advantages and specific objects obtained by its use, reference is made to the accompanying drawings and descriptive matter in which preferred embodiment of the invention are illustrated and in which:

DETAILED DESCRIPTION OF THE PREFERRED EMBODIMENT

Figure 1:
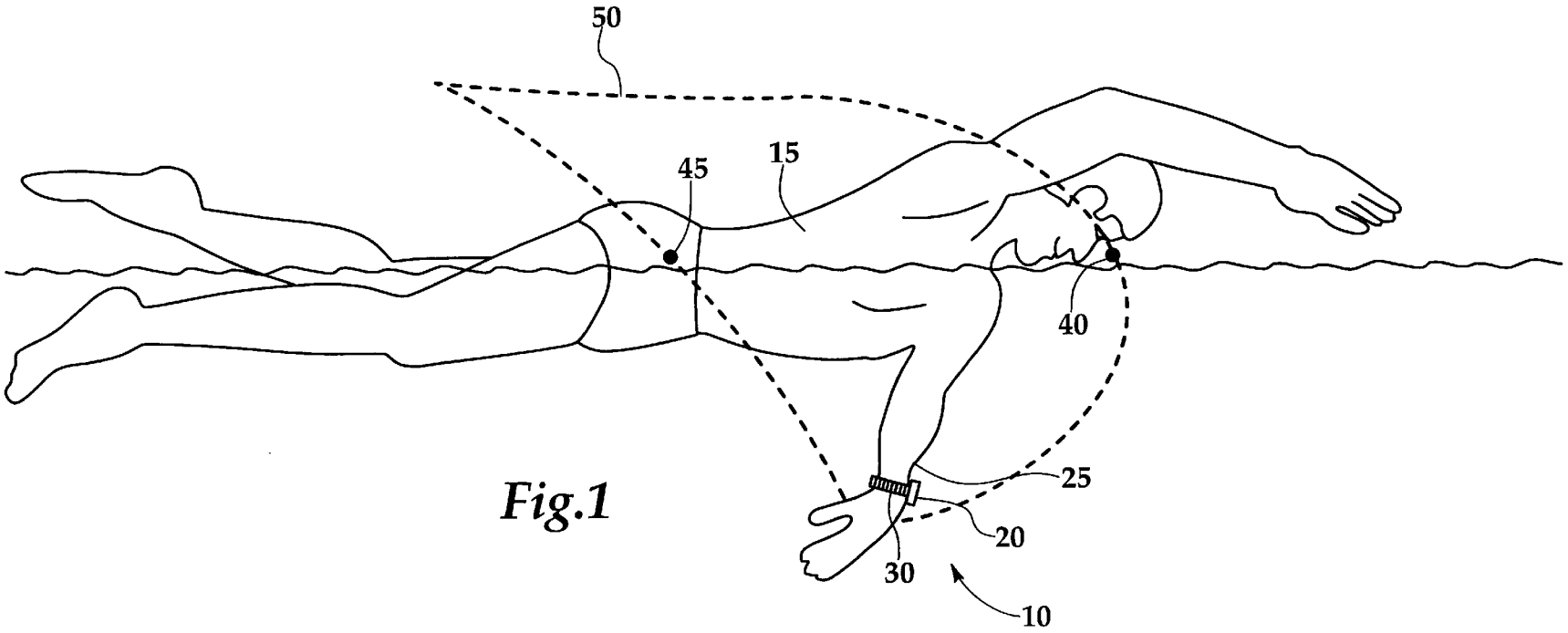
FIG. 1 illustrates the preferred method of use of the device in accordance with one embodiment of the invention.

In reference to FIG. 1, the preferred method of use is illustrated and denoted generally as 10. FIG. 1 shows a swimmer 15 performing a swim exercise and wearing the device 20 about the wrist 25. As shown, device 20 is mounted to the wrist 25 with strap 30 which can consist of a buckle-type two piece watch strap or a single piece strap or band attached to the device enclosure. Preferably, the watch strap 30 is adjustable and durable so as to resist the various elements, such as water, salt, chlorine and other chemicals, which may be encountered by the swimmer 15.

The dashed line in FIG. 1 represents the typical swim stroke cycle 50 and follows a path outlined by the swimmer's hand and wrist 25 as the swimmer performs the swim exercise. The device 20 fits snugly around the swimmer's wrist 25 with strap 30 which secures the device 20 so it does not come loose or dislodge during motion. The wrist 25 penetrates the water at entry point 40 and exits at point 45 causing the swimmer 15 to swim a given distance.

While FIG. 1 depicts use of a single device 20 strapped to one wrist 25, it should be readily understood that the device 20 may be used on either wrist or that the invention may be practiced as two (2) separate devices, one on each wrist, and still be within the scope of the invention as disclosed and claimed. The two (2) device configuration may in some circumstances may provide more accurate swim stroke information.

Figure 2:
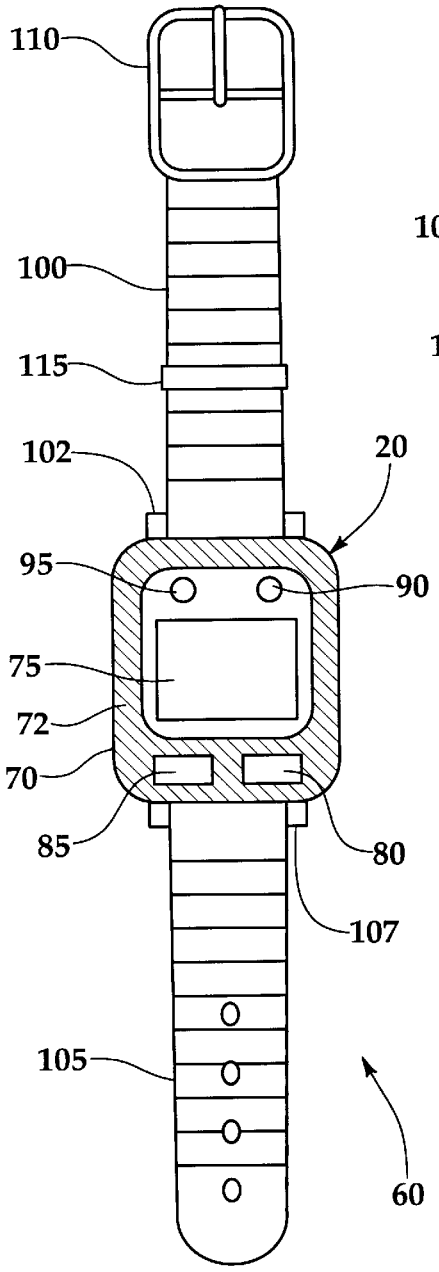
FIG. 2 illustrates the top side view of the device in accordance with the preferred embodiment of the invention.

Turning now to FIG. 2, a top side view of the invention is shown and denoted generally as numeral 60. Device 20 has an instrument enclosure 70 which houses the internal components of the device 20. Instrument enclosure 70 is shown as a substantially rectangular shaped box with a flat upper surface but it should be understood that other shapes, sizes and configurations may be used. Instrument enclosure 70 is made waterproof material to ensure the internal components are not exposed to the elements. In the preferred embodiment, instrument enclosure 70 is made of a durable but lightweight plastic.

A display 75 comprises a clear see window through which the user may view swim stroke information. Display 75 sits flush with the top surface 72 of instrument enclosure 70. In other configurations, display 75 may be raised slightly above the instrument enclosure 70 for aesthetic or design purposes. It has been found, however, that a surface 72 with a low coefficient of tension to permit easy run-off of water achieves the best results. In other words, in the preferred embodiment, surface 72 is designed to permit water to slip away easily once the swimmer's wrist 25 exits the water.

Controls 80 and 85 extend from the top of the instrument enclosure 70 for controlling the various device 20 functions. It should be understood, however, that more or less controls may be employed and that their placement on the instrument enclosure 70 or any other part of the device 20 does not effect the true scope and nature of the invention.

A first sensor 90 and second sensor 95 are provided and in the preferred embodiment sit flush with the top surface of the instrument enclosure 70. First sensor 90 and second sensor 95 are made of a metallic conducting material such as steel, copper, iron, aluminum or other similar conductor. It is the first sensor 90 and second sensor 95 that allow the device 20 to perform its stroke counting function by acting as a signal path to an internal microprocessor interrupt signal when the device 20 is sufficiently submerged in water. When the device 20 is submerged, the water on the surface of the instrument enclosure 70 forms a bridge extending from first sensor 90 to second sensor 95 thereby creating a short circuit between the two sensors. Likewise, when the device 20 is lifted out of the water, the path is broken causing and opening of the signal path between first sensor 90 and second sensor 95.

The first sensor 90 and second sensor 95 are coupled to an internal microprocessor within the instrument enclosure 70. Thus, as a swimmer 15 completes a stroke cycle 50, the presence and absence of water across the surface 72 of the device 20 and, in particular, the shorting and opening of the signal path between first sensor 90 and second sensor 95 allows the device 20 to count strokes.

A first strap 100 and second strap 105 are coupled to the instrument enclosure 70 at end 102 and end 107, respectively, and allow the swimmer 15 to mount the device 20 on his wrist 25 and keep it secure during the swim exercise. Alternatively, a single strap or band can be used to perform the same function. A buckle 110 extends from the first strap 100 permitting the swimmer 15 to adjust the fit of the device 20. Also, a strap holder 115 can be used to keep the second strap 105 in place and out of the way while swimming.

Figure 3:
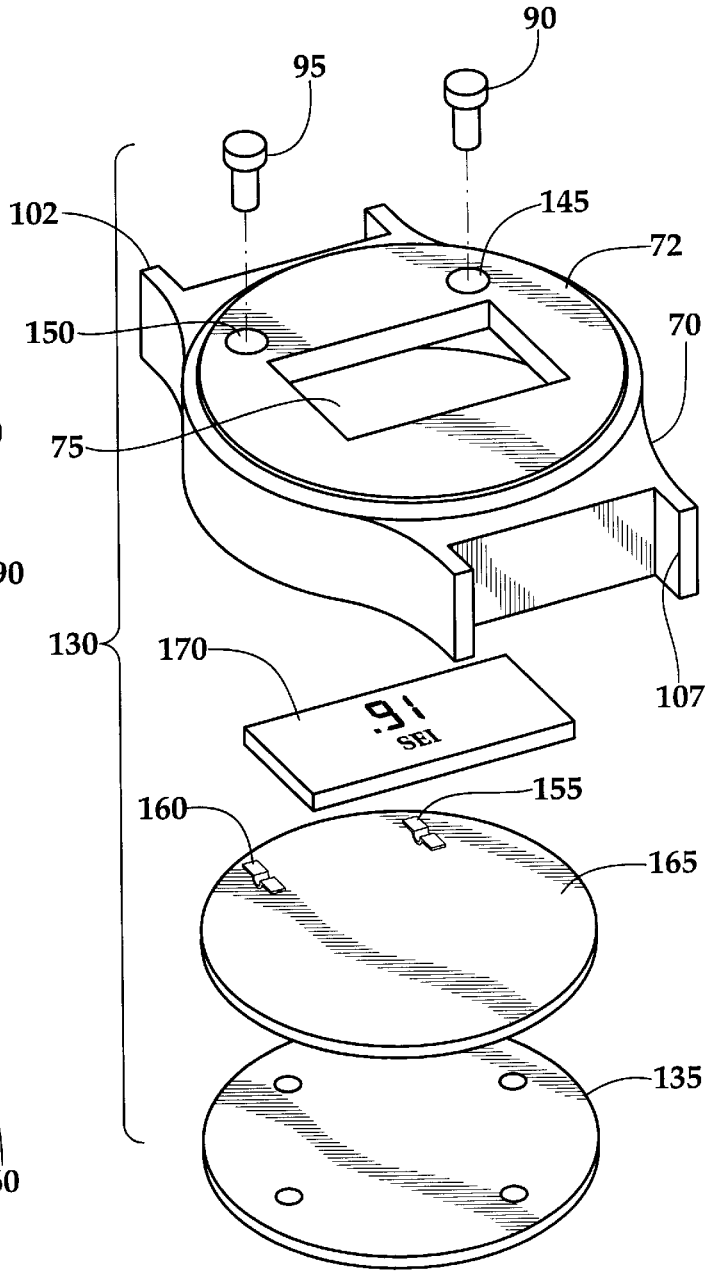
FIG. 3 shows the internal layer construction of the device enclosure in accordance with the preferred embodiment of the invention.

Turning now to FIG. 3, a detailed view of the internal layers of the device 20 is shown and denoted generally as 130. View 130 shows that instrument enclosure 70 is shaped slightly different than that show in FIG. 2, but still acts as a housing for all of the device layers. Instrument enclosure 70 is coupled to bottom 135 to form a waterproof chamber. As shown, top surface 72 is a smooth flat surface on top of the instrument enclosure 70 and contains display 75. Display 75 comprises a portion of the top surface 72 large enough to permit a view of any information that is displayed such as characters, numbers and graphics as the case may be. It should be understood, however, that top surface 72 may be configured in other shapes and varied in texture as long as surface tension is maintained to permit water run-off. Specifically, top surface 72 may be curved, rounded or grooved to achieve such a result.

A first opening 145 and second opening 150 are also provided on the top surface 72 to which first sensor 90 and second sensor 95, respectively, are secured. In the preferred embodiment, first sensor 90 and second sensor 95 form screw-like structures which penetrate the top surface 72 of the instrument enclosure 70 and make contact with point 155 and point 160, respectively, on circuit layer 165. Point 155 and point 160 are coupled to circuit layer 165 and are used to connect first sensor 90 and second sensor 95 to the electronics (not shown) on circuit layer 165. It is circuit layer 165 that contains the internal microprocessor of the device 20 as well as other electronics necessary to perform device functions in accordance with the invention as herein described.

A LCD 170 is also shown in between the circuit layer 165 and display 75. In operation LCD 170 is operably coupled to a display driver circuit on the circuit layer 165 which cause the LCD 170 to display swim data.

Figure 4:
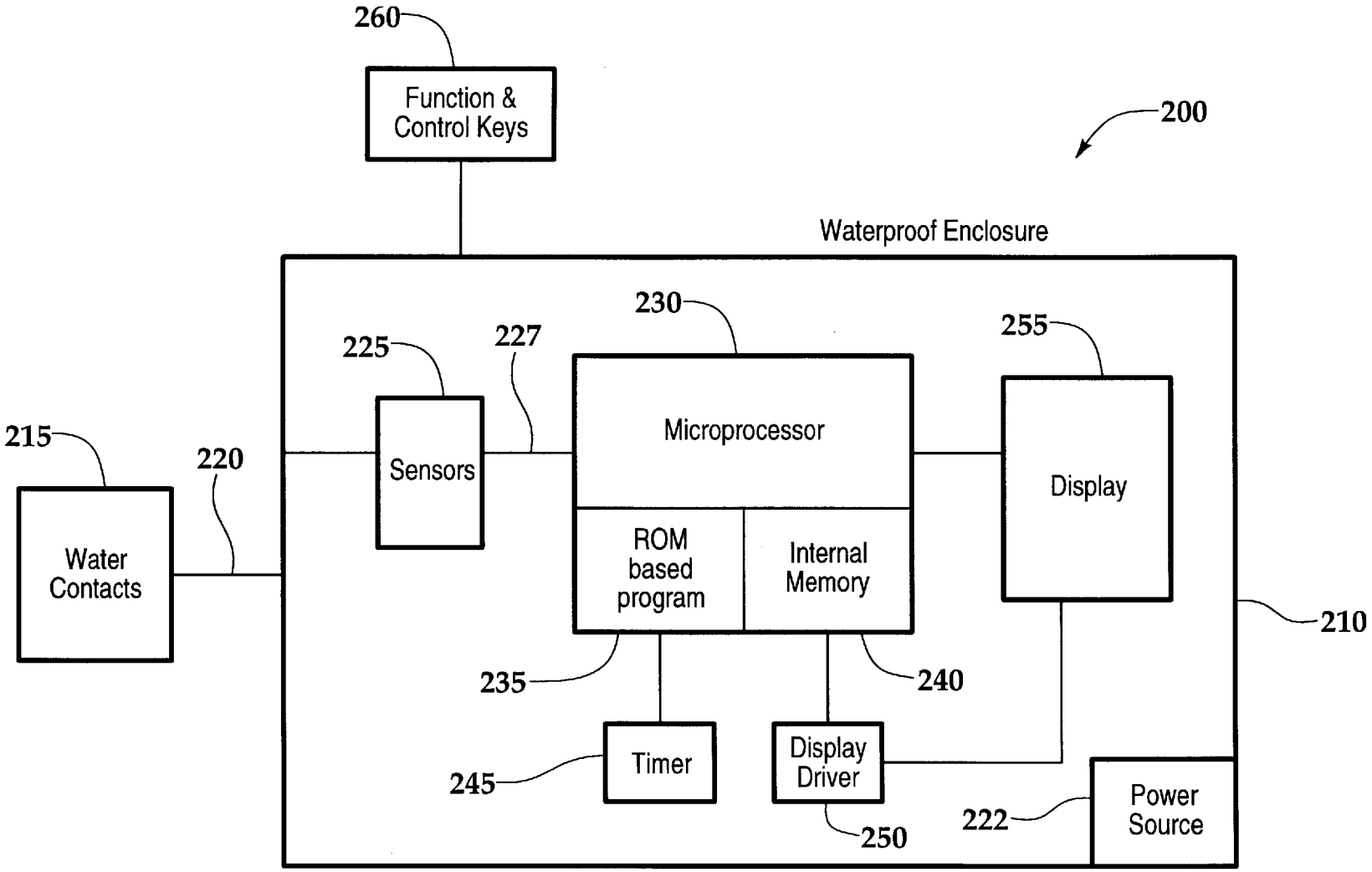
FIG. 4 is a functional block diagram of the device in accordance with one embodiment of the invention.

In reference to FIG. 4, a block diagram of the device in accordance with the invention is shown and denoted generally as 200. Waterproof enclosure 210 is used to house the internal electronics of the device 20. A set of water contacts 215 are coupled to the waterproof enclosure 210 and used to sense the presence of water whenever the user's wrist is submerged. When this condition occurs, a signal travels along path 220 which is detected by internal sensors 225. The internal sensors 225 are in turn coupled to the microprocessor 230 via path 227. A power source 222, such as a battery cell, pack, charged capacitor or similar component is used to supply power to the various internal device components.

In operation, a signal from the water contacts 215 is detected by sensors 225 which causes an interrupt of the microprocessor 230. As depicted in FIGS. 2 and 3, water contacts 215, path 220 and sensors 225 can be implemented with the use of first sensor 90 and second sensor 95, however, other implementations are possible and it is expected that such other implementations are within the scope of the invention.

The presence of an interrupt signal is interpreted by the microprocessor 230 as a swim stroke which means the device 20 has been sufficiently submerged in water. To make sure the interrupt signal was accurate, the microprocessor 230 is programmed to check the status of the interrupt approximately 1 millisecond after the interrupt was first detected. This check ensures the swimmer's hand is still submerged in the water and that an actual swim stroke is taking place.

Likewise, the absence of an interrupt signal corresponds to the device 20 being lifted out of the water.

As shown, the microprocessor 230 has ROM programs 235 and internal memory space 240. The ROM programs 235 are permanent instructions which control the microprocessor's functions and operations and are placed in the device during manufacturing. The internal memory 240 is used by the microprocessor 230 for storage of data. For example, past swim performance data can be stored in the internal memory space 240. Although FIG. 4 shows the ROM programs 235 and internal memory space 240 as integrated into the microprocessor 230, it should be readily understood that they can be separate components within the device 20.

A timer 245 is coupled to the microprocessor 230 and is used to provide incremental time information. The microprocessor 230 controls the display drivers 250 which, in turn, drive the display unit 255. In this way data can be presented to the user.

While FIG. 4 shows the timer 245, microprocessor 230 and display drivers 250 as separate elements of the device 20, it should be understood that all components may be integrated into a single apparatus or components such as a high scaled integrated circuit (VLSI or LSI, for example). Other configurations may also be achieved without departing from the scope and spirit of the invention.

The user controls the device 20 with functions buttons 260 which are outside the waterproof enclosure 210 and allows the user to select from the various options such as START/STOP, mode select, display results and other functions as herein described.

In one mode of operation, microprocessor 230 maintains an elapsed time for a particular distance swam and counts the total number of strokes from the time device 20 senses a first swim stroke to when the user depresses a STOP function on the device 20. Results are stored in internal memory 240 which the user can view or save and recall later.

Figure 5:
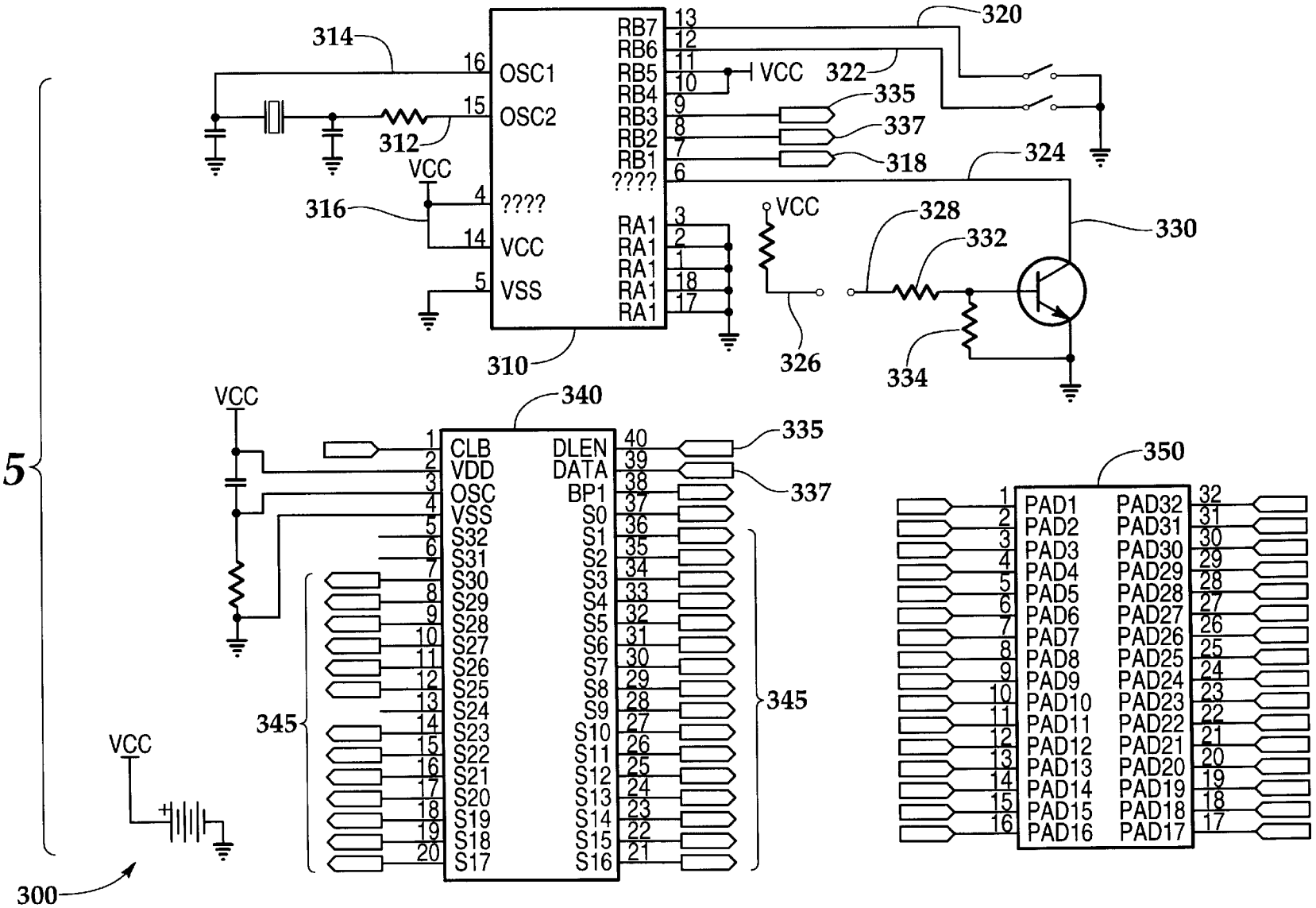
FIG. 5 is a schematic circuit diagram for implementing the various device functions and operations in accordance with the preferred embodiment of the invention.

Turning now to FIG. 5, a circuit diagram of the internal components used in one embodiment is shown and denoted generally as 300. A microprocessor 310 has a plurality of inputs and outputs associated with it. For example, oscillator inputs 312 and 314 are used to synchronize the various device components on a standard clock line permitting synchronous data communications. Power is supplied via VCC input 316 and a clock input 318 provides the internal timer functions which, for example, device 20 uses to calculate elapsed time. It should be understood that any microprocessor 310 is generic in nature and that any readily available micro computing device could be used.

FIG. 5 also shows interrupt signal 324 coupled to the microprocessor 310 Interrupt signal 324 is driven by the action of transistor 330, which in turn, is driven by water contacts 326 and 328. The water contacts 326 and 328 are coupled to the first sensor 90 and second sensor 95 which extend outside the instrument enclosure 70. Given the properties of water as a perfect conductor, when the device 20 is submerged current flows from one sensor to another causing transistor 330 to pull current and toggle interrupt signal 324 to the microprocessor 310. Likewise, when the path between the first sensor 90 and second sensor 95 is broken, the interrupt signal 324 is high corresponding to the device 20 being raised out of the water. It should be understood that other arrangements of implementations are possible and may be achieved without departing from the true scope and nature of the invention.

Also resistors 332 and 334 work in conjunction with transistor 330 to suppress noise that would otherwise superimpose itself interrupt signal 324. It should be understood that the values of resistors 332 and 334 may change and the particular type of transistor 330 used is inconsequential to the invention.

A mode switch 320 and START/STOP switch 322 are coupled to the function keys on the device 20 which the user operates. As shown, mode switch 320 and START/STOP switch 322 are coupled to the microprocessor 310 which the microprocessor 310 interprets accordingly and based on the position of the switches 320 and 322 performs the indicated function.

Data enable 335 and data 337 signals couple the microprocessor 310 to the display driver 340 permitting the exchange of data between the two components. Display driver 340 has a bus 345 which drives the LCD 350 for representing data to the user.

It should be understood that the components depicted in FIG. 5 form part of and are maintained on the circuit layer 165 within the instrument enclosure 70. Also, many of these components including microprocessor 310, display driver 340 and LCD 350 are commonly available in the industry and that the invention should not be limited by the particular model or type employed.

Figure 6:
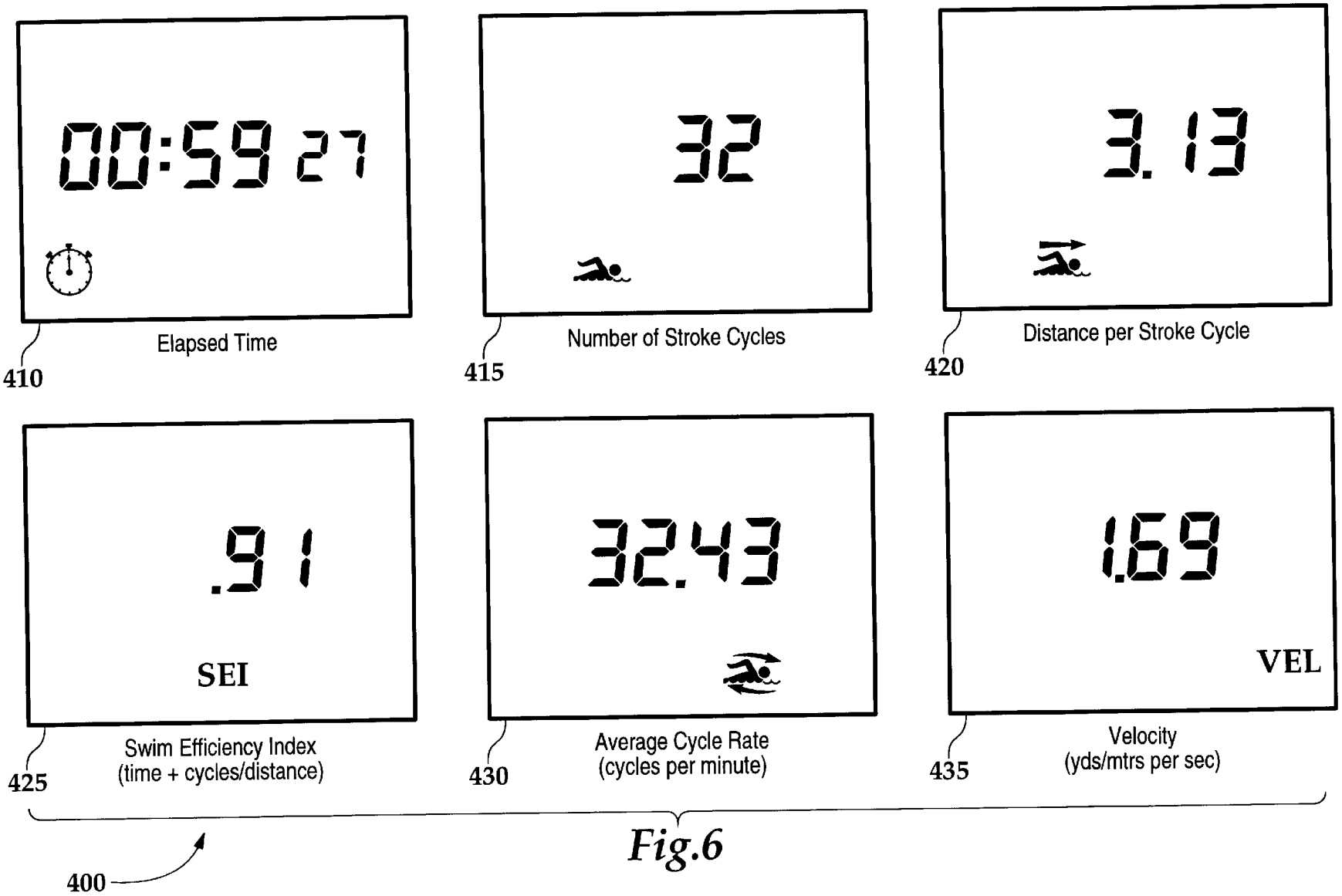
FIG. 6 illustrates the various displays and information displayed by use of the device in accordance with one embodiment of the invention.

FIG. 6 shows the various screen displays, collectively denoted 400, which are presented to the user via the LCD 350 in one embodiment of the invention. The elapsed time screen 410 provides the user with the total elapsed time for a given distance swam. In this regard, the user has the option to select a particular distance from a menu (not shown) on the device 20 or the use may simply depress the STOP/START switch 322 at the beginning of the exercise and again at the end of the exercise.

A number of strokes cycles screen 415 is also provided which informs the use of the total number of strokes for a particular distance swam. Thereafter, by dividing the total distance swam by the number of strokes, the microprocessor 310 can compute the swimmers distance per stroke cycle as illustrated by screen 420. Other indicators of swim performance are visually represented to the user via screens 425, 430 and 435 which include the swim efficiency index, average cycle rate and velocity, respectively., It should be understood that display screens 400 are included to illustrate one embodiment of the invention and that the particular screens 400 shown should not limit the invention as more or less screen displays may be used and the information represented differently to the user without departing from the teachings herein.

Figure 7:
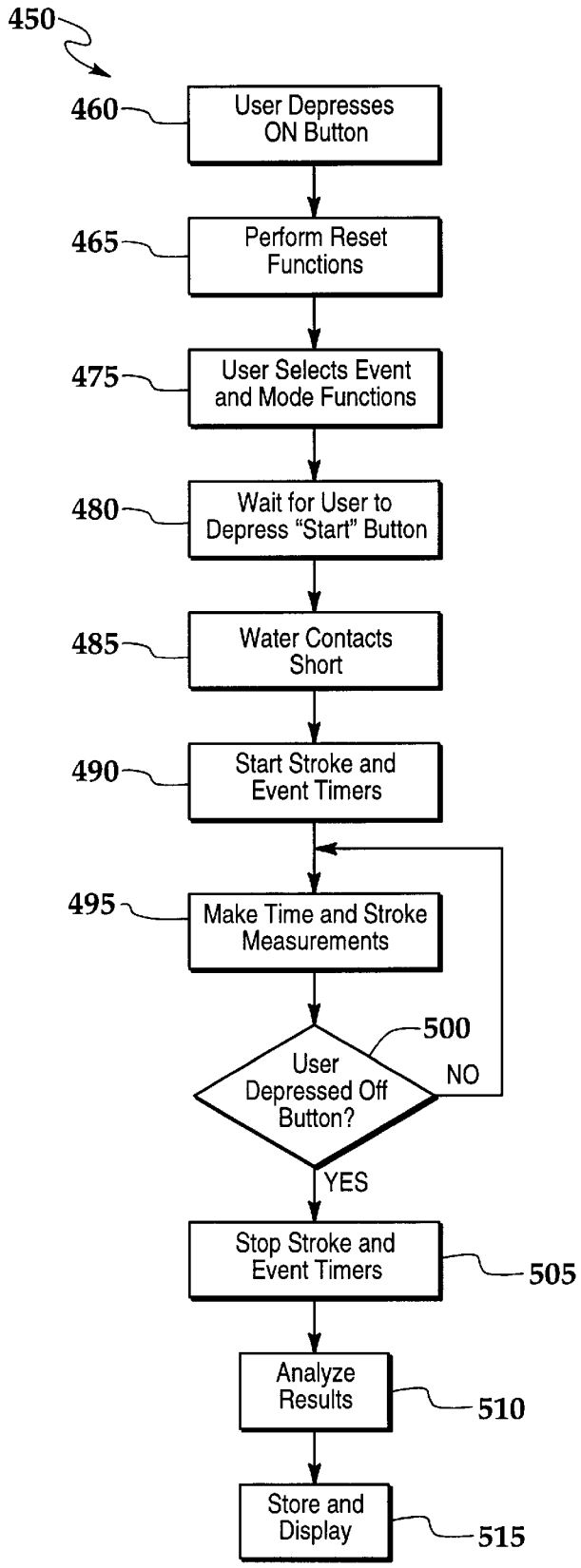
FIG. 7 is a process flow diagram illustrating the method of taking measurements in accordance with the preferred embodiment of the invention.

Turning now to FIG. 7, the process used to measure and analyze swim performance is depicted as a flowchart and denoted generally as 450. A user initiates the process 450 by depressing an "ON" button 460 on device 20 which causes a reset function 465 to be performed. Next, a user selects event and mode options 475 via function buttons 80 and 85. For example, in step 475, the user has the option among others to select a particular distance to swim, recall previous swim data and display current data. Also, the user may select between different swim modes such as a mode to calibrate the device 20, a mode for recreational swimmers and a mode for the more advanced swimmers in training. Other options may be provided.

At this point, the device 20 is ready to make swim stroke measurements when the user depresses an ON button 480 wherein process flow is directed to step 485 where the device 20 is waiting for water to short the path between first sensor 90 and second sensor 95 once the device 20 has been submerged in enough water. Once this occurs, the elapsed time counters are started 490 marking the beginning of an event. Stroke measurement are made 495 wherein an internal stroke counter is incremented for each stroke cycle detected by the microprocessor 310 corresponding to successively openings and closings the path between first sensor 90 and second sensor 95. Step 495 involves counting the number of times the swimmer's wrist 25 enters the water a sufficient depth to cause the interrupt signal 324 to be toggled and detected by the microprocessor 310.

Measurements 495 continue until a user depresses an "OFF" button 500 on device 20 such as function button 80 or 85. Once the user depresses the "OFF" button, the internal stroke and elapsed time counters stop 505 and the internal microprocessor 310 calculates 510 a plurality of swim performance data based on the total elapsed time, distance swam and number of strokes taken. Finally, in step 515 the results are stored and displayed to the user.

Figure 8:
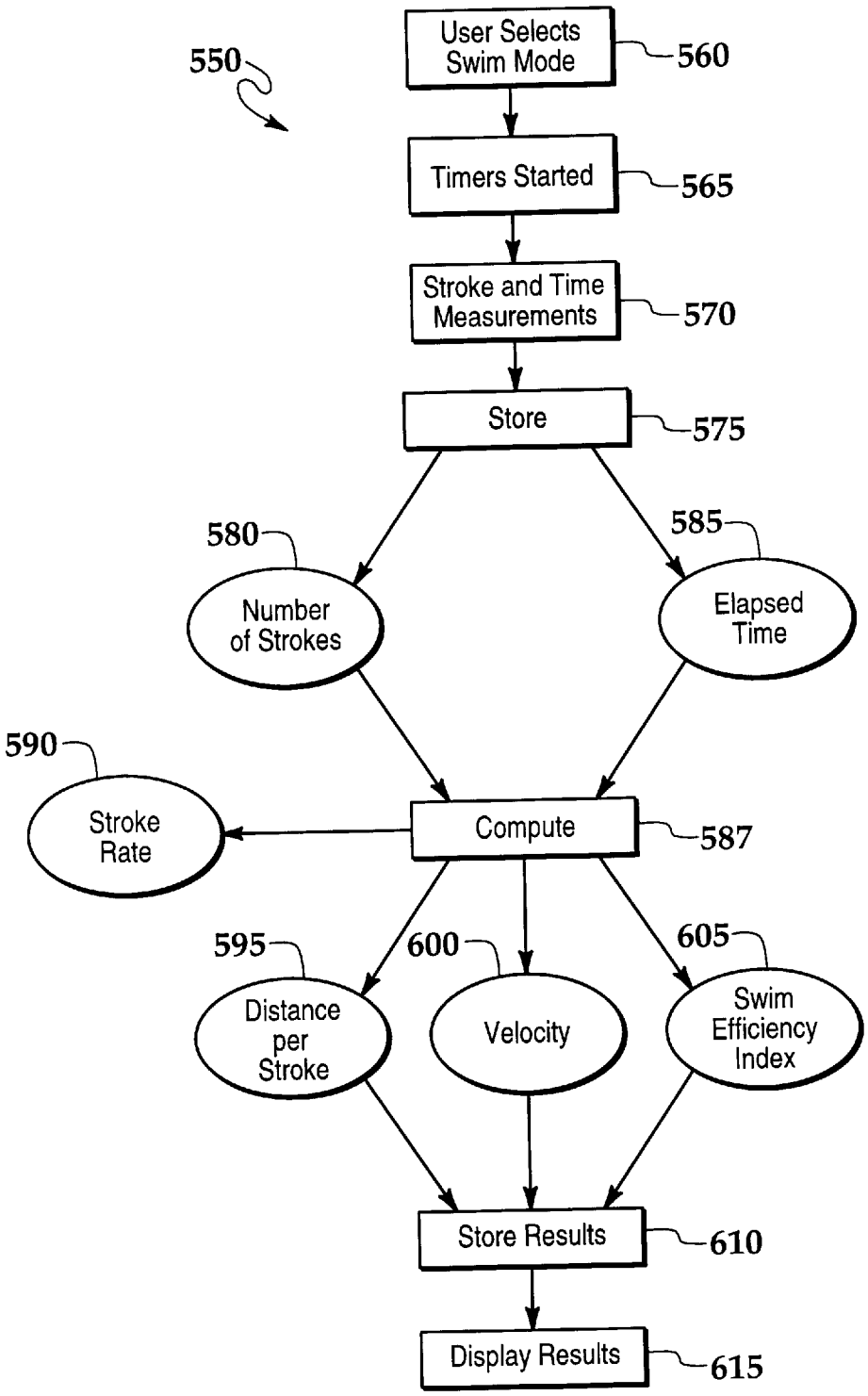
FIG. 8 is a process flow diagram illustrating the method of computing swim performance indicators in accordance with the preferred embodiment of the invention.

Turning to FIG. 8, the process for computing swim performance indicators is illustrated in flow chart form and denoted generally as 550. To begin process 550, a user selects a swim mode 560 such as the distance to swim, calibration mode, recreational mode and training mode to cause the internal timers the device 20 to begin 565. By storing 575 the number of strokes 580 and total elapsed time 585 for a given distance swam by the user, the microprocessor 310 can compute 587 various swim performance indicators.

For example, in one embodiment the microprocessor 310 is programmed to compute stroke rate 590 (Number of strokes divided by time or distance), distance per stroke 595 (distance divided by total number of strokes), velocity 600 (elapsed time divided by distance) and the swimmer's Swim Efficiency Index 605 (SEI). The SEI 380, in particular, indicates the number of strokes (in seconds) plus the total elapsed time divided by the total distance swam. Thus, in one embodiment the higher an SEI 605, the less efficient a particular swimmer is as compared to other swimmers or as the swim distance increases. In another embodiment, the SEI 605 is inverted to reflect a lower value as swim efficiency increases.

Process flow continues to storing results 610 in an internal memory space 240 prior to displaying the results 615 to the user.

While the invention has been described with reference to a single preferred embodiment in the form of a wrist mounted device for measuring, analyzing and displaying swim performance data, it should be understood that the components, functions and overall embodiment disclosed may be utilized in other contexts or incorporated into other formats. For example, the device 20 can be incorporated into a watch having typical time and data functions in addition to those described above. Also, the device 20 may be mounted to other parts of a swimmer's body such as the hand or fingers and still be within the scope of the invention.

"Processor" or "microprocessor" in some contexts is used to mean that a microprocessor is being used on the circuit layer 165 board but may also mean that a memory block (RAM, cache, DRAM, flash memory and the like) coprocessor subsystem and the like is being used. The usage herein is that terms can also be synonymous and refer to equivalent things. The phrase "circuitry" comprehends ASIC (Application Specific Integrated Circuits), PAL (Programmable Array Logic), PLA (Programmable Logic Array), decoders, memories, non-software based processors, or other circuitry, or digital computers including microprocessors and microcomputers of any architecture, or combinations thereof. Words of inclusion are to be interpreted as nonexhaustive in considering the scope of the invention.

Internal and external connections, couplings, communications links, circuit or signal pathways can be ohmic, capacitive, direct or indirect, via intervening circuits or otherwise. Implementation is contemplated in discrete components or fully integrated circuits in silicon, gallium arsenide, or other electronic material families, as well as in optical-based or other technology-based forms and embodiments. It should be understood that various embodiments of the invention can employ or be embodied in hardware, software or micro coded firmware. Process diagrams are also representative of flow diagrams for micro coded and software based embodiments.

Modifications of this invention will occur to those skilled in the art. Therefore, it should be understood that this invention is not limited to a particular device or process disclosed, but that the specification is intended to cover all such modifications which are within the true spirit and scope of this invention as claimed.

What is claimed is:

1. A device for analyzing a swimmer's performance by calculating a plurality of swim stroke data comprising:

an enclosure having a top surface with a surface tension that permits water run-off;

a display fixed to said top surface of said enclosure;

a circuit layer contained within said enclosure;

a first sensor fixed to a first location on said top surface and extending to a first point on said circuit layer;

a second sensor fixed to a second location of said top surface and extending to a second point on said circuit layer;

a bottom coupled to said instrument enclosure for creating a waterproof chamber about said circuit layer; and a processing means insides said waterproof chamber and arranged to sense a short circuit generated when water forms a bridge from said first sensor to said second sensor to permit said processing means to count swim strokes and calculate said plurality of swim stroke data.

2. The device in accordance with claim 1 wherein said bridge from said first sensor to said second sensor causes an interrupt signal to said processing means to be generated.

3. The device according to claim 1 wherein said circuit layer further comprises:

a microprocessor having at least one interrupt signal input;

a display driver circuit operably coupled to said microprocessor; and a Liquid Crystal Display ("LCD") operably coupled to said display driver circuit for displaying said plurality of swim stroke data via said display.

4. The device according to claim 3 wherein said interrupt signal input is coupled to either one of said first sensor or said second sensor.

5. The device according to claim 3 wherein said microprocessor is preprogrammed to calculate said plurality of swim stroke data.

6. The device according to claim 1 further comprising:

a first strap coupled to a first end of said instrument enclosure; and a second strap coupled to a second end of said instrument enclosure, said second strap having an adjustable securing means for joining to said first strap.

7. The device according to claim 3 wherein said circuit layer further includes:

a timer means communicably linked to said microprocessor;

and a power source coupled to said microprocessor, said display drive circuit, said LCD and said timer means for supplying operating current.

8. The device according to claim 3 further comprising function buttons attached to said top surface of said instrument enclosure, said function buttons coupled to said microprocessor for operating a plurality of device functions.

9. A wrist mounted instrument for measuring, analyzing, calculating and displaying a plurality of swim data comprising:

an enclosure having a top surface with an attached display screen for viewing said swim data, said enclosure having at least two openings extending from said top surface and said top surface having a shape that permits water run-off when said wrist mounted instrument is removed from a body of water;

a bottom coupled to said enclosure for creating a waterproof chamber;

first and second sensor elements coupled to an exterior portion of said enclosure and extending through said two openings to points on said internal circuit layer; and a micro-processing means contained entirely within said waterproof chamber and configured to measure, analyze, calculate and display said plurality of swim data by sensing the opening and closing of a signal path formed between said first and second sensor elements caused when said wrist mounted instrument is repetitively inserted and removed from water.

10. The instrument according to claim 9 wherein said top surface forms a substantially smooth exterior layer of said enclosure, said layer having a characteristically low coefficient of tension to permit water run-off.

11. The instrument according to claim 9 further including first and second strap components for securing said instrument to a swimmer.

12. The instrument according to claim 9 wherein said plurality of components include at least one microprocessor, one power source, one timer means and one display driver means.

13. The instrument according to claim 12 further including a Liquid Crystal Display operably coupled to said display driver means, said Liquid Crystal Display contained entirely within said waterproof chamber.

14. The instrument according to claim 12 further including at least one function button operably coupled to said microprocessor for controlling a plurality of measuring, analyzing, calculating and displaying functions.

15. The instrument according to claim 12 wherein said micro-processor has at least one interrupt input signal coupled to one of first and second sensor elements.

16. The instrument according to claim 12 wherein said micro-processor has an internal memory means for storing at least some of said plurality of swim data.

17. The instrument according to claim 12 wherein said microprocessor is preprogrammed to calculate a plurality of swim performance indicators including swim cycle rate, distance per stroke, velocity and Swim Efficiency Index (SEI).

18. A method of analyzing a swimmer's swim performance using a microprocessor based wrist mounted instrument with at least two sensors coupled to a surface, said method including the steps of:

a) initiating stroke and elapsed time counters;

a) repetitively inserting and removing the instrument into and out of the water;

b) sensing the water bridge formed between the two sensors each time the instrument is inserted into the water;

d) incrementing said stroke counter each time the water bridge is sensed.

19. The method according to claim 18 further comprising the steps of:

a) stopping said time counter once a swimmer depresses a function button on said instrument; and b) using the timer and stroke counter to determine elapsed time and number of strokes during the elapsed time.

20. The method in accordance with claim 19 further including the steps of:

a) storing the elapsed time and number of strokes in an internal memory area of said instrument; and b) using the elapsed time and number of strokes to calculate a plurality of swim performance indicators including stroke rate, distance per stroke, velocity and swim efficiency index.

21. The method in accordance with claim 20 further including the step of displaying said plurality of swim performance indicators on a display of said instrument.

* * * * *